US007431021B1

(12) United States Patent
Achor

(10) Patent No.: US 7,431,021 B1
(45) Date of Patent: Oct. 7, 2008

(54) FUEL VAPOR SEPARATOR

(75) Inventor: Kyle D. Achor, Monticello, IN (US)

(73) Assignee: Federal - Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 11/857,575

(22) Filed: Sep. 19, 2007

(51) Int. Cl.
*F02M 33/02* (2006.01)
*F02M 33/04* (2006.01)

(52) U.S. Cl. ..... 123/520; 123/519

(58) Field of Classification Search ..... 123/520, 123/519, 518, 516, 509; 137/587, 588, 589; 251/129.21, 129.15
See application file for complete search history.

(56) References Cited

U.S. PATENT DOCUMENTS

| | | | | |
|---|---|---|---|---|
| 1,683,338 | A | 9/1928 | Evinrude | |
| 4,753,262 | A | 6/1988 | Bergsma | |
| 4,809,666 | A * | 3/1989 | Baltz | 123/516 |
| 4,887,578 | A | 12/1989 | Woodcock et al. | |
| 5,054,528 | A | 10/1991 | Saitoh | |
| 5,313,977 | A | 5/1994 | Bergsma et al. | |
| 5,413,137 | A | 5/1995 | Gimby | |
| 5,522,417 | A | 6/1996 | Tomioka et al. | |
| 5,605,177 | A | 2/1997 | Ohashi et al. | |
| 5,647,331 | A | 7/1997 | Swanson | |
| 5,669,358 | A * | 9/1997 | Osakabe | 123/509 |
| 5,944,076 | A | 8/1999 | Palvoelgyi | |
| 5,950,655 | A | 9/1999 | Benjey | |
| 5,975,116 | A | 11/1999 | Rosas et al. | |
| 6,032,654 | A | 3/2000 | Kato | |
| 6,167,920 | B1 | 1/2001 | Enge | |
| 6,253,802 | B1 | 7/2001 | Enge | |
| 6,276,192 | B1 | 8/2001 | Sim et al. | |
| 6,443,190 | B1 | 9/2002 | Enge | |
| 6,494,227 | B2 | 12/2002 | Hattori et al. | |
| 6,516,835 | B2 | 2/2003 | Enge | |
| 6,553,974 | B1 | 4/2003 | Wickman et al. | |
| 6,601,617 | B2 | 8/2003 | Enge | |
| 6,718,953 | B1 | 4/2004 | Torgerud | |
| 6,779,546 | B2 | 8/2004 | Hattori | |
| 6,854,492 | B2 | 2/2005 | Benjey | |
| 6,857,419 | B1 * | 2/2005 | Harvey et al. | 123/509 |
| 6,941,966 | B2 | 9/2005 | Mori et al. | |
| 6,971,374 | B2 * | 12/2005 | Saito | 123/516 |
| 7,013,878 | B1 | 3/2006 | Cotton et al. | |
| 2001/0025668 | A1 | 10/2001 | Enge | |
| 2002/0023688 | A1 | 2/2002 | Enge | |
| 2005/0279406 | A1 | 12/2005 | Atwood et al. | |
| 2006/0243656 | A1 * | 11/2006 | Ooiwa | 210/497.1 |
| 2007/0101974 | A1 * | 5/2007 | Achor | 123/516 |

FOREIGN PATENT DOCUMENTS

| | | | |
|---|---|---|---|
| EP | 1426225 | A1 | 6/2004 |

* cited by examiner

*Primary Examiner*—Mahmoud Gimie
(74) *Attorney, Agent, or Firm*—Robert L. Stearns; Dickinson Wright PLLC

(57) ABSTRACT

A fuel vapor separator used in fuel delivery systems of a marine engine for recovery of fuel vapors and to prevent fuel spills when the engine is tilted.

17 Claims, 4 Drawing Sheets

FUEL VAPOR SEPARATOR

BACKGROUND OF THE INVENTION

1. Technical Field

This invention is related to a fuel vapor separator used in fuel delivery systems of a marine engine for recovery of fuel vapors and to prevent fuel spills when the engine is tilted.

2. Discussion

Small outboard marine engines are usually detachable and mounted to the transom of a boat. These engines typically include an integrated fuel system which draws liquid fuel under suction from a can or tank in the boat. The fuel is routed through a vapor separator unit to condense or recover vapors to be burned by the engine through the air intake system. The fuel in the vapor separator is delivered at high pressure to the fuel injection system. Larger inboard or inboard/outboard marine engines also typically include an integrated fuel system which draws fuel from under suction and is routed through a vapor separator unit to capture and combust the captured vapors by the engine to prevent fuel vapor build-up in enclosed areas of the boat.

The marine industry has long recognized that fuel vapors on boats are an issue, particularly in enclosed compartments. To prevent fuel spills, boat safety regulations have long required that fuel routed between a tank and engine be sucked under a vacuum instead of being provided at pressure, as is commonly performed in the automobile industry. Therefore, fuel is withdrawn from the tank at a negative pressure to prevent fuel spilling into the boat, should the fuel line rupture. However, at low pressures, fuel readily vaporizes, especially when combined with high temperatures near engines and jarring conditions as a boat passes over waves. Beyond capturing vapors to prevent emissions or to prevent the potential for uncontrolled combustion of vapors near an engine, if vapors are in the fuel provided to the engine, a condition known as vapor lock may occur.

Vapor separators are designed to address the above vapor issues. Some vapor separators allow heated fuel from the fuel rail of the fuel injectors to be returned and any vapors present in the fuel rail to be condensed back into a liquid before the fuel is reintroduced to the high pressure pump and provided to the fuel rail of the injector system. In some outboard motors, the vapors may be vented to the atmosphere by the vapor separator however in engines that are enclosed in compartments, the fuel vapor is provided to the engine fuel intake system through a vacuum line connection and combusted in a controlled manner within the engine.

Vapor separators include a vapor vent valve in most marine applications with a float actuated valve for automatically closing the vent line whenever the fuel level in the separator rises above a predetermined level. This float valve prevents liquid fluid from being provided into the air intake of the engine through the vacuum line designed to provide only fuel vapors to the engine. Additionally, the float mechanism is also designed to close the vent line, in particular for removable outboard motors, when the engine is tipped so that liquid fuel does not drain out of the vapor vent.

Prior art fuel vapor vent valve arrangements are commonly a buoyant float supported by the liquid fuel just below the vapor line connected to a needle valve which closes when the liquid fuel lifts the float. A typical prior art needle vent valve system 200 is depicted in FIG. 1. These needle valves 200 include floats 202 commonly carried on a pivot pin 204, with the rotational axis of the float pivot being oriented parallel relative to the pivotal axis of the engine mounting bracket so that the float will close the vent passage 206 with a needle valve 208 whenever the engine is rotated to a tilt condition such as an in an outboard motor with the prop out of the water. Closing the passage when the engine is tilted prevents the liquid fuel from running through the vapor separator when the engine is shut off and tilted or prevents liquid fuel from running through the vapor portion of the vapor vent valve to the air intake of the engine while it is running.

Many outboard marine engines are often configured to be manually removed from the boat after the use and stored. When the engine is removed, users commonly lay the engine on its side to protect the prop and tiller arm when placing the engine on a trailer, in a vehicle cargo area, or perhaps on the bed of a pick-up truck. When the marine engine is laid on its side, the pivotal axis of the vent valve mechanism is no longer aligned with the engine and many times the float valve will not properly close the needle valve or the needle valve later becomes displaced during transit which may allow liquid fuel to leak through the vapor exit on the vapor separator to the engine, engine compartment, or area within the engine is stored. Accordingly, an improved fuel vapor separator in which the vent control device can accommodate engine tipping in non-conventional directions is desirable. It is also desirable to have a vapor separator that does not allow solid fuel to vent through the vapor outlet during engine operation due to vibrations or jarring, such as wavy conditions where the valve or float is moved, even though liquid fuel is present, thereby allowing liquid fuel to splash into the vapor outlet. Any splashing of liquid fuel into the vapor outlet causes, in systems where the vapor outlet is connected to the air intake allows liquid fuel to be provided to the air intake of the engine causing a condition of too much fuel, commonly resulting in stalling of the engine. Therefore, it is desirable to prevent instantaneous venting due to vibration and allow for control of when the vapor is vented through the vapor separator.

Vapor separators are not used in automotive applications because the factors which produce excessive vapors in marine applications are generally not present. Furthermore, vehicles have typically less concern regarding fuel vapor build-up in enclosed areas of the vehicle. Some automotive emission systems incorporate a "roll-over" vent valve into the fuel tank, however these are passive features in the emission system that simply protect the open vent line to a vapor collection canister. The automotive engine would continue to operate unaffected and without interruption if the roll-over vent valve was disabled or removed. In comparison, in marine systems where the vapor vent valve is an active component of the engine, any failure or malfunction potentially would disable the engine entirely.

SUMMARY OF THE INVENTION

In view of the above, the present invention comprises a fuel supply system for a marine engine. The fuel supply system includes a vapor separator having an enclosed interior chamber for collecting a volume of liquid fuel and fuel vapors. A suction pump transfers liquid fuel under negative pump pressure from a remote fuel tank to the interior chamber. A high pressure pump transfers liquid fuel under positive pressure from the interior chamber to a fuel injection system of the engine. This high pressure fuel pump is located close to the intake or injectors on the engine as typically regulations prevent pressurized fuel lines from being longer than eighteen inches on a marine vessel. The vapor separator includes a vent valve device communicating with the interior chamber for permitting the escape of fuel vapors trapped in the interior chamber. The vent valve device includes an enclosed top end permeated by an escape passage. A needle valve is disposed on a spring and is biased by the spring to operatively seal a vent passage. A magnetic coil may be attached to a relay and a thermistor circuit that senses when liquid fuel is present. When the thermistor senses that liquid fuel is not present it may switch a relay that provides power to the magnetic coil which opens the needle valve. The magnetic coil may further be controlled by a control module, such as the engine control module, which controls a relay to switch off and on the magnetic coil.

The system is designed to prevent the escaping of fuel, even when the engine power is off. For example, when power is off, such as when the engine is not running, the spring biases the needle valve to a closed position preventing escape of vapors and liquid fuel. When liquid fuel is sensed as being present, and power is being provided, such as when the engine is running or the ignition of a vehicle is turned on, the system causes the needle valve to remain closed as power is not provided to the coil. When no fuel is present, and power is on, power may be supplied to the coil, allowing the needle valve to open. To prevent opening of the needle valve due to vibrations or other temporary removal of fuel from contact with the thermistor, the thermistor circuit may be programmed with a delay such as a ½ second to one second, or more, before venting vapor by turning on the magnetic coil to open the needle valve, therefore preventing accidental discharge of fuel through the vapor vent from vibrations or waves. Furthermore, by being biased to the closed position, such as when the engine is off, prevents escape of fuel for when outboard motors are transported and the escape of vapors when the engine is off.

The fuel supply system according to the subject invention overcomes the short comings and disadvantages of the prior art by providing a unidirectional vent valve device for a vapor separator of a marine engine that also allows control of the timing of venting of fuel vapors from the vapor separator.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 1:
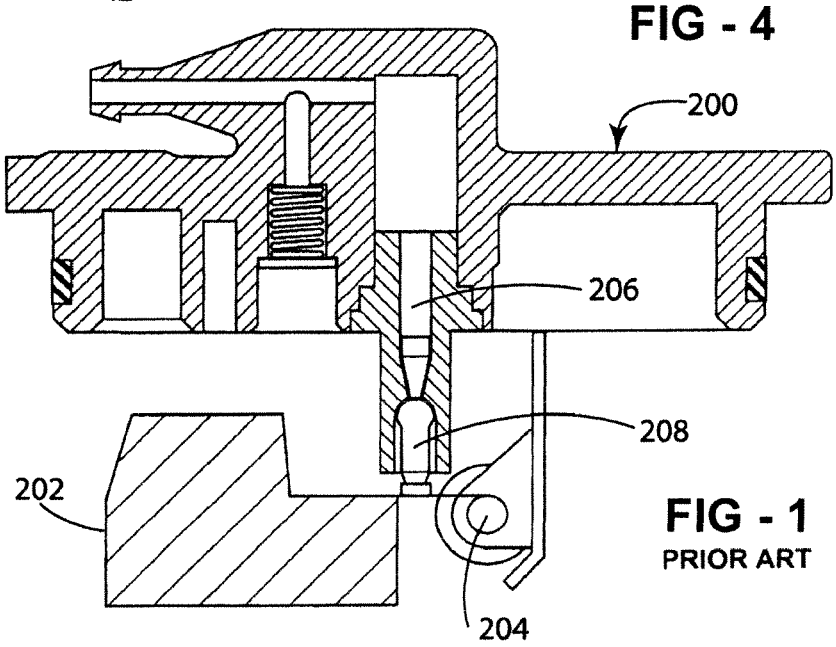
FIG - 1 PRIOR ART
FIG. 1 is a cross-sectional view of a prior art vent control device.
Figure 2:
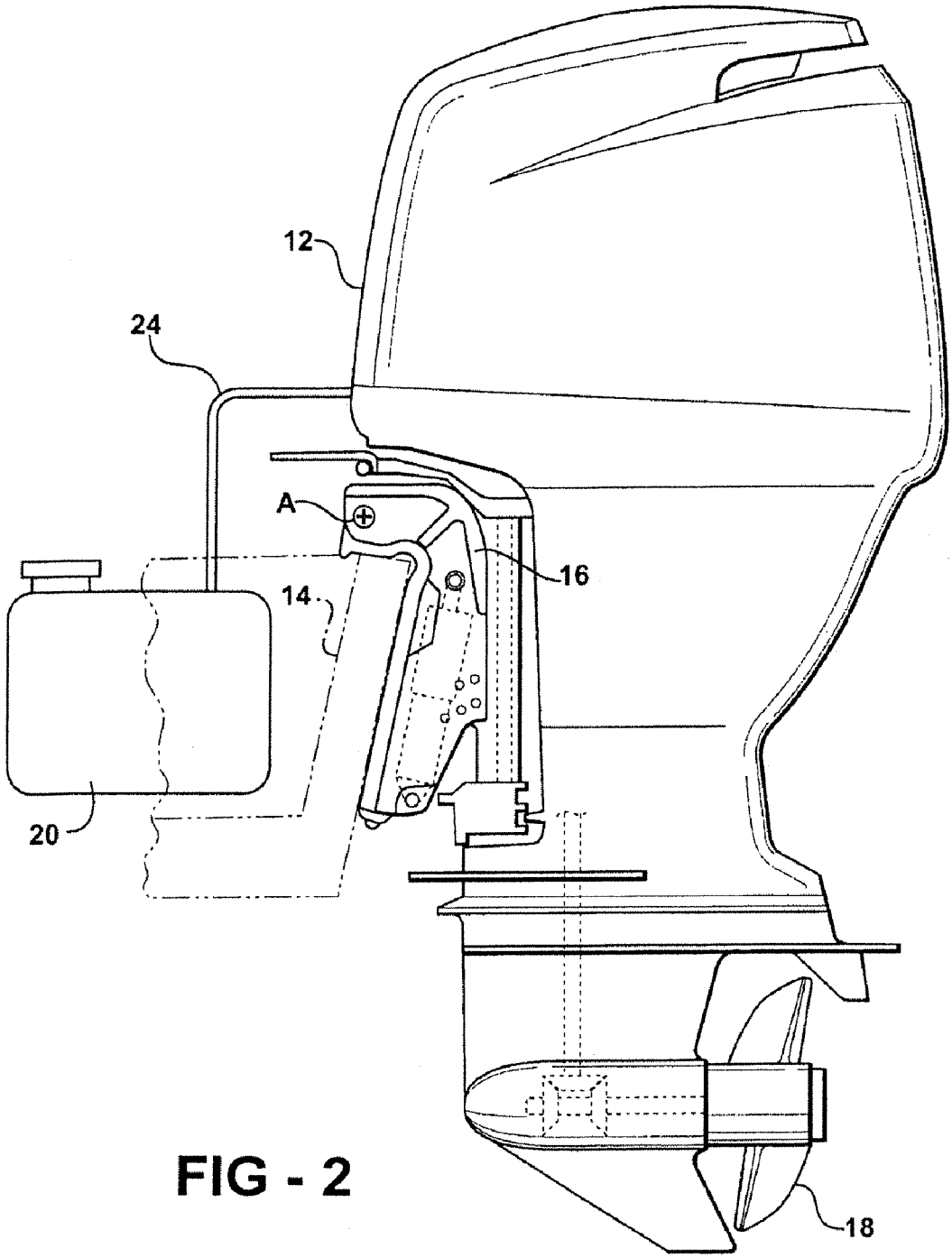
FIG. 2 is a side elevational view of a typical outboard marine engine.

A vapor valve separator 28 for an engine 12 is generally illustrated in the figures. While FIG. 1 illustrates an outboard marine engine 12 affixed to the transom 14 of a boat, the engine 12 may be any marine engine. Small outboard marine engines 12, such as illustrated in FIG. 2, are usually mounted on a bracket 16 so that the engine 12 can be quickly removed from the boat for transportation and/or maintenance. The bracket 16 includes a tilting feature which allows the motor head to be rotated toward the boat with the propeller 18 swinging up out of the water to facilitate launching and maneuvering through shallow water conditions. As an example, the motor 12 may be pivoted about axis A between a use and a non-use provision, as well as for trim control. While the engine 12 is illustrated in FIG. 2 as being an outboard motor, the vapor separator 28 of the present invention may be easily applied to inboard/outboard engines or inboard engines that are permanently affixed within compartments on the boat.

Figure 3:
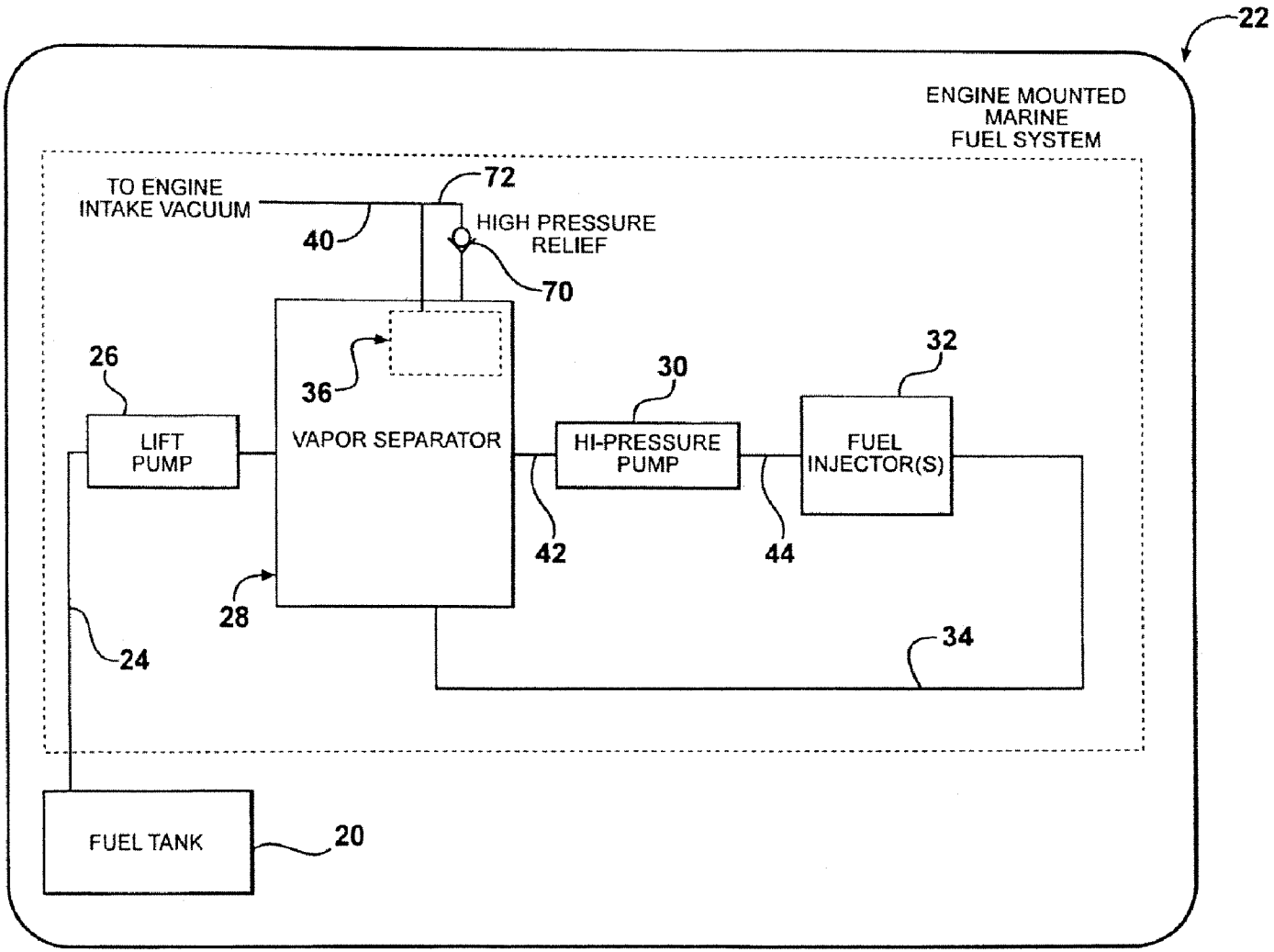
FIG. 3 is a schematic diagram of a fuel delivery system for an outboard marine engine.

The marine engine 12 draws liquid fuel from a fuel tank 20 by an engine mounted fuel system generally shown as 22 in FIG. 3. While the fuel tank 20 is illustrated in FIG. 2 as a smaller fuel tank, it should be readily recognized that any type of fuel tank including any size configuration or shape may be used with the present invention. Except for the fuel tank 20 and the supply line 24, the fuel system 22 on marine engines is generally fully integrated with the engine 12 so that the components are located as close as possible to the engine to meet regulations such as that a high pressure fuel line must be no longer than eighteen inches. For the exemplary outboard motor 12 illustrated in FIG. 2, when the engine 12 is removed from the boat, the fuel system 22 may be removed with the engine 12, however the fuel tank 20 and fuel line 24 may stay with the boat or be removed separately. However in some instances, the fuel tank 20 may also be removed along with the engine 12.

Figure 4:
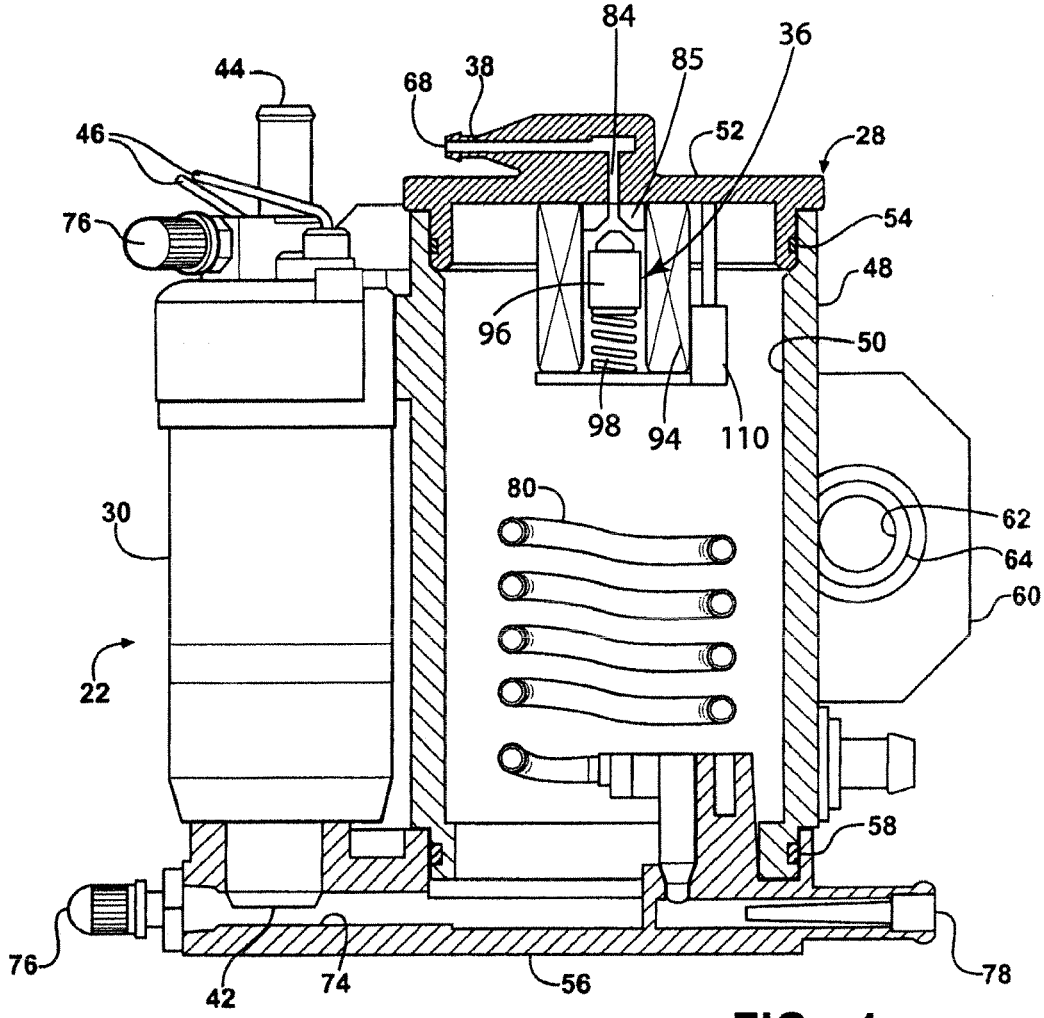
FIG. 4 is a cross-sectional view of a marine vapor separator according to the subject invention with the needle valve in an open position.

As illustrated in FIG. 3, a low pressure fuel supply pump 26 or lift pump typically pulls fuel from the tank 20 through a supply line 24. The fuel is delivered to a vapor separator, generally indicated in FIGS. 3 and 4 as 28. The vapor separator 28 collects and discharges vapors given off due to incoming low fuel pressure, normal vaporization of the fuel, vaporization due to proximity to the hot engine, and vaporization from hot agitated fuel returning from the engine under some circumstances. The high pressure pump 30 may be connected to the vapor separator 28 as shown in FIG. 4 and pumps the fuel under pressure to the cylinders of the engine such as through a fuel injector system 32. In some other embodiments, the high pressure pump 30 may not be directly connected to the vapor separator. Unused fuel may be returned to the vapor separator 28 via return line 34. However in some embodiments, fuel is not returned to the vapor separator and the system does not include a return line. The vapor separator 28 further includes a vent device 36 which for most marine engines, including outboard engines, is provided with a vacuum fitting 38 for connection to the engine air intake system. The vacuum creates a negative pressure in the vent line 40 so that fuel vapors may be cycled through the air intake of the engine.

In an exemplary vapor separator 28 is depicted in FIG. 4, however one skilled in the art would readily recognize that the size, shape, and configuration of the vapor separator 28 may vary depending upon spacing, location, and engine requirements. The exemplary vapor separator 28 illustrated in FIG. 4 includes an integral high pressure fuel pump 30. The high pressure fuel pump 30 includes a fuel intake 42 and an outlet 44 which communicates with the fuel injector system 32. Electrical power is supplied to the high pressure pump 30 through wires 46. Although not illustrated in FIG. 4, the lift pump 26 or low pressure fuel pump can also be integrally included with the vapor separator 28. In some embodiments a valve 76, such as a Schrader valve, is provided at the top of the high pressure pump 30 to allow pressure testing of the outlet pressure.

The vapor separator 28 also includes in fluid communication with the high pressure pump 30 a hollow generally cylindrical housing 48 forming a hollow interior chamber 50. A wall assembly 52 having a vapor outlet 68 is coupled to the cylindrical housing 48 and in the illustrated embodiment includes an O-ring 54 sealing the perimeter of the wall 52 against the housing 48 to create a liquid and vapor tight seal. Of course, a variety of other configurations may be used to assemble or create the hollow interior chamber 50 for retaining fuel and holding a vent valve device 36.

As illustrated in FIG. 4, the housing 48 may also be coupled to a wall assembly having a fuel intake 78. Of course, this wall assembly 56 may be formed integrally with the housing 48. However, as illustrated in FIG. 4, an O-ring seal 58 may also seal the junction between the housing 48 and the wall assembly 56 to prevent liquid or vapor leakage. The vapor separator 28 may also include a mounting flange 60 for attachment to the engine 12. The mounting flange 60 may be made in any size, shape, or configuration, however, is illustrated in FIG. 4 as having an opening 62 including a rubber grommet 64 positioned within the opening 62 to provide isolation from vibration.

Figure 5:
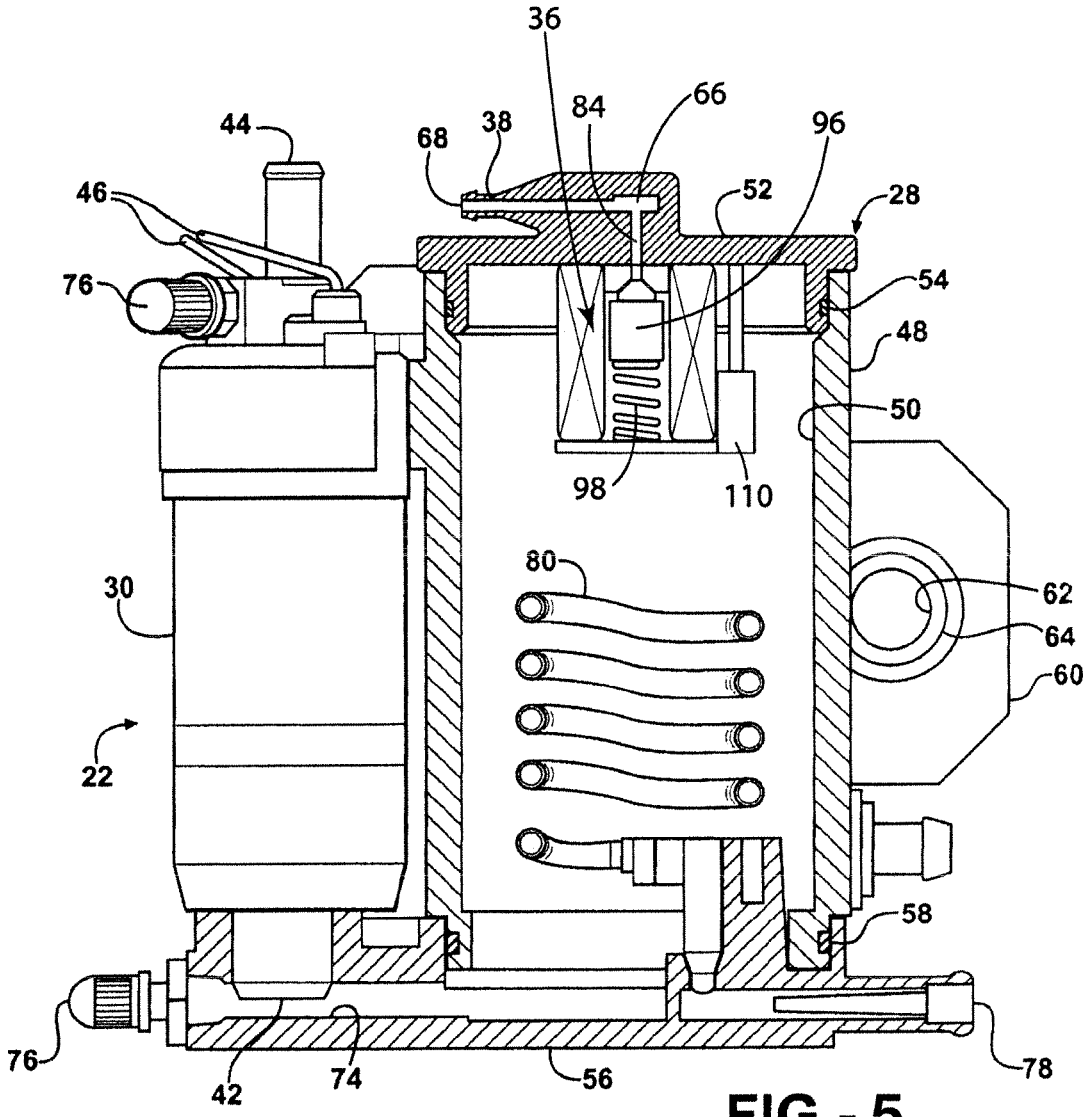
FIG. 5 is a cross-sectional view of a marine valve vapor separator in a closed position.

The vapor separator 28 includes the vent valve device 36. The vent valve device 36 includes a biasing element such as a spring 98 for moving a needle valve 96 against a valve seat 85 on a vapor escape passage 84. The vent valve 36 may be further configured to have a casing enclosing the needle valve 96 and biasing element 98. The biasing element 98 typically biases the needle valve 96 against the valve seat 85 as the needle 96 is illustrated in FIG. 5 in a closed position. The needle valve 96 may be formed out of a magnetic material so that a coil 94 surrounding the needle valve 96 may move the needle valve 96 from the biased closed position as illustrated in FIG. 5 to an open position as illustrated in FIG. 3. In the opened position, fuel vapors may escape through the vapor escape passage 84 and out the vapor outlet 68. The vent valve 36 further includes a fuel level detector 110 that may communicate with a control module (not shown) to control the coil 94. In some embodiments, the fuel level detector 110 is connected to a relay (not shown) that switches the coil 94 on an off as needed. The fuel level detector 110 is typically a simple thermistor circuit the system and may include a time delay before activating the coil 94 to prevent accidental discharge of liquid fluid. Thus the vapor vent device 36 does not need a float assembly mounted to the biasing element 98. Further, unlike the prior art where a biasing element biases the float in an open position or only biases toward closed in the presence of liquid fuel as it can not support the float in the absence of fuel, in the present invention, the biasing element biases the valve in a closed position even in the absence of fuel.

A valve 76 such as a Schrader valve may be positioned at the end of the fuel inlet channel for drainage and pressure release. The fuel inlet 78 for the low pressure pump 26 extends through the wall assembly 56 and communicates with the internal chamber 50, typically through the hollow portion 74 of the wall assembly 56. In some embodiments, an optional cooling coil 80 may be positioned within the chamber 50 to circulate cooling fluid and act as a heat exchanger for cooling the fuel contained within the chamber 50 to minimize vaporization.

To allow for easy assembly of the vapor separator 28, the valve vent device 36 may include a casing (not illustrated) enclosing all of the parts. This casing allows for easy assembly by insertion into a cavity on the wall assembly 52 of the vapor separator 28.

The biasing element 98, even when fuel is not present, maintains the needle valve 96 in a closed position as illustrated in FIG. 5 and in particular the point 95 of the needle valve 96 against the valve seat 85. As the biasing element 98 normally biases the needle valve to a closed position, when the engine 12 is not operating and when electricity is not flowing to the coil 94, the needle valve is maintained in a closed position against the valve seat 85. When the engine 12 is in operation and power is supplied to the fuel level detector 110, as long as the fuel level is higher than the fuel level detector 110, the needle valve 96 will remain in the closed position as illustrated in FIG. 5. However, when the fuel level is below the fuel level detector 110, the needle valve may be moved by the coil 94 into an open position as illustrated in FIG. 3. A time delay may be included in the fuel level detector circuit 110 to prevent the coil 94 from opening the needle valve 96 when fuel is temporarily not in contact with the fuel level detector 110 such as through vibrations or wave action or motion of the boat. For example, in water conditions including large waves the boat may significantly rock back and forth and the fuel level in the vapor valve separator 28 may intermittently not contact the fuel level detector 110 even though the fuel level is near the top of the vent valve device 36. Due to this intermittent contact, if the time delay is not operational, and the coil 94 opens the needle valve 96 each time the fuel level detector 110 detected a low fuel level, at times liquid fuel may escape out of the vapor outlet 68 and enter the engine air intake system causing potentially a stalled engine. This is particularly troublesome in water conditions such as wavy conditions and therefore the fuel level detector 110 typically will include a time delay that ensures the fuel level actually is lower than the fuel level detector 110 to ensure that when the needle valve 96 opens only vapor escapes through the passage 68.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A vapor separator for a marine engine, said vapor separator comprising:

a biasing element;

a valve outlet including a valve seat;

a needle valve between said biasing element and said valve outlet, said basing element being configured to bias said needle valve against said valve seat;

a coil capable of generating a magnetic field for moving said needle valve relative to said valve seat; and a fuel level detector circuit electrically coupled to said coil and wherein said fuel level detector circuit is configured to activate said coil upon sensing a low fuel condition.

2. The vapor separator of claim 1 further including a timing circuit to delay activation of the coil upon sensing a low fuel level condition.

3. The vapor separator of claim 1 further including a control circuit for controlling power to said coil.

4. The vapor separator of claim 1 wherein said needle valve is biased to a closed position when the marine engine is off.

5. The vapor separator of claim 1 wherein the marine engine includes a power system having at least one of a battery and an alternator and wherein said vapor separator further includes a control circuit and wherein when no power is supplied by the power system to said control circuit, said needle valve is biased to a closed position by said biasing element.

6. The vapor separator of claim 1 further including a control circuit for controlling said coil and wherein said control circuit also provides engine management control functions.

7. The vapor separator of claim 1 wherein said needle valve is biased to a closed position when the marine engine is off.

8. The vapor separator of claim 1 wherein the marine engine includes a power system having at least one of a battery and an alternator and wherein said vapor separator further includes a control circuit and wherein when no power is supplied by the power system to said control circuit, said needle valve is biased to a closed position by said biasing element.

9. The vapor separator of claim 1 further including a control circuit for controlling said coil and wherein said control circuit also provides engine management control functions.

10. A vapor separator for a marine engine, said vapor separator comprising:

a biasing element;

a valve outlet including a valve seat;

a needle valve between said biasing element and said valve outlet, said basing element being configured to bias said needle valve against said valve seat;

a coil capable of generating a magnetic field for moving said needle valve relative to said valve seat;

a control circuit for controlling power to said coil; and a thermistor in communication with said control circuit and wherein when said thermistor senses liquid fuel, said control circuit prevents power from being supplied to said coil.

11. A vapor separator for a marine engine, said vapor separator comprising:

a biasing element;

a valve outlet including a valve seat;

a needle valve between said biasing element and said valve outlet, said basing element being configured to bias said needle valve against said valve seat;

a coil capable of generating a magnetic field for moving said needle valve relative to said valve seat; and wherein the marine engine includes a power system having at least one of a battery and an alternator and wherein said vapor separator further includes a control circuit having a thermistor for sensing liquid fuel and wherein when power is supplied by the power system to said control circuit, and said thermistor senses liquid fuel, said control circuit prevents power from reaching said coil and said needle valve remains in a biased closed position.

12. A vapor separator for a marine engine, said vapor separator comprising:

a biasing element;

a valve outlet including a valve seat;

a needle valve between said biasing element and said valve outlet, said basing element being configured to bias said needle valve against said valve seat;

a coil capable of generating a magnetic field for moving said needle valve relative to said valve seat; and wherein the marine engine includes a power system having at least one of a battery and an alternator and wherein said vapor separator further includes a control circuit having a thermistor for sensing liquid fuel and wherein when power is supplied by the power system to said control circuit, and said thermistor does not sense liquid fuel, said control circuit allows power to flow from the power system to said coil and wherein said coil moves said needle valve to an open position.

13. The vapor separator of claim 12 wherein said control circuit is configured to hold said needle valve in an open position as long as said thermistor does not sense liquid fuel.

14. The vapor separator of claim 12 wherein said control circuit includes a timing delay which prevents power from being supplied to said coil when said thermistor does not sense liquid until after a specified time period has passed.

15. A fuel supply system for a marine engine, said fuel supply system including:

a vapor separator having a substantially enclosed interior chamber for collecting a volume of liquid fuel and fuel vapors;

a vent valve device communicating with said interior chamber of said vapor separator, said vent valve device comprising a biasing element, a valve outlet including a valve seat, a needle valve between said biasing element and said valve outlet, said basing element being configured to bias said needle valve against said valve seat, and a coil capable of generating a magnetic field for moving said needle valve relative to said valve seat; and a fuel level detector electrically coupled to a control circuit and wherein when said fuel level detector detects liquid fuel within said vapor separator, said control circuit interrupts the supply of power to said coil.

16. The fuel supply system of claim 15 wherein when said fuel level detector detects the absence of liquid fuel within the vapor separator, said control circuit allows power to pass to said coil, said powered coil moving said needle valve to an open position.

17. A vapor separator for a marine engine having a power system, said vapor separator comprising:

a biasing element;

a valve outlet including a valve seat;

a needle valve between said biasing element and said valve outlet, said basing element being configured to bias said needle valve against said valve seat in a closed position;

a coil capable of generating a magnetic field for moving said needle valve relative to said valve seat to an open position;

wherein said vapor separator has at least three operating states including a no power operating state wherein the power system is not providing power and the needle valve is in the closed position, a power on and fuel detected state wherein the power system is providing power and the needle valve is in the closed position, and a power on and no fuel detected state wherein the power system is providing power and the needle valve is in the open position; and a control circuit including a timing delay circuit to prevent the needle from moving to the open position for a set time period after the fuel level detector senses that no fuel is in the vapor separator and wherein when said power system is supplying power, said control circuit receives input from a fuel level detector regarding the presence of fuel in the vapor valve separator and moves the needle to the open position only when fuel is not detected by the fuel level detector.

* * * * *